US010480731B2

(12) United States Patent
Liu et al.

(10) Patent No.: US 10,480,731 B2
(45) Date of Patent: Nov. 19, 2019

(54) MUNICIPAL WARNING LAMP

(71) Applicant: Xiaojun Liu, Shenzhen (CN)

(72) Inventors: Xiaojun Liu, Shenzhen (CN); Caixia Wang, Shenzhen (CN); Junlong Liu, Shenzhen (CN)

(73) Assignee: Xiaojun Liu, Shenzhen (CN)

( * ) Notice: Subject to any disclaimer, the term of this patent is extended or adjusted under 35 U.S.C. 154(b) by 0 days.

(21) Appl. No.: 16/243,096

(22) Filed: Jan. 9, 2019

(65) Prior Publication Data

US 2019/0242540 A1 Aug. 8, 2019

(30) Foreign Application Priority Data

Feb. 8, 2018 (CN) ..... 2018 1 012878

(51) Int. Cl.

| | |
|---|---|
| ***G08G 1/095*** | (2006.01) |
| ***F21S 9/03*** | (2006.01) |
| ***F21V 29/67*** | (2015.01) |
| ***F21V 23/00*** | (2015.01) |
| *F21Y 113/10* | (2016.01) |

(52) U.S. Cl.

CPC ..... *F21S 9/035* (2013.01); *F21V 23/003* (2013.01); *F21V 29/67* (2015.01); *G08G 1/095* (2013.01); *F21Y 2113/10* (2016.08)

(58) Field of Classification Search

None

See application file for complete search history.

(56) References Cited

U.S. PATENT DOCUMENTS 2,165,562 A * 7/1939 Mack ..... B60Q 7/00 206/223
2,838,744 A * 6/1958 De Wald ..... G08G 1/0955 340/908.1
3,729,706 A * 4/1973 Hein ..... G08G 1/0955 340/908
3,995,250 A * 11/1976 Ferree ..... E01F 9/696 340/908
4,032,883 A * 6/1977 Gibson ..... F21S 8/028 340/908
4,447,802 A * 5/1984 Bose ..... B60Q 7/00 116/63 P
4,535,331 A * 8/1985 Koenig ..... F21S 9/022 116/63 P
4,547,761 A * 10/1985 Jones ..... G08B 7/064 340/331
4,736,186 A * 4/1988 Jones ..... G08B 7/064 340/331

(Continued)

*Primary Examiner* — John F Mortell

(57) ABSTRACT

A municipal warning lamp includes control box and a warning lamp post arranged on an upper portion of the control box. The warning lamp post is of a cuboid structure. At least three warning lights with different colors are arranged on each side of the warning lamp post. A power supply, a controller, a temperature and humidity sensor, a network communication transmission unit, an alerter, a data memory, a first telescopic driving cylinder, a second telescopic driving cylinder, and a BLUETOOTH transmission unit are arranged in an interior of the control box. A second telescopic rod is connected to an upper portion of a first telescopic rod connected with an upper portion of the warning lamp post

6 Claims, 3 Drawing Sheets

(56) References Cited

U.S. PATENT DOCUMENTS

| | | | | | |
|---|---|---|---|---|---|
| 5,755,174 | A * | 5/1998 | Freeman | B60Q 7/00 | 116/63 C |
| 5,986,576 | A * | 11/1999 | Armstrong | F21V 21/06 | 116/63 P |
| 6,118,388 | A * | 9/2000 | Morrison | G08G 1/0955 | 340/907 |
| 6,637,904 | B2 * | 10/2003 | Hernandez | B60Q 7/00 | 362/11 |
| D596,064 | S * | 7/2009 | Marzette, Jr. | D10/115 | |
| 7,683,772 | B2 * | 3/2010 | Smith | B60Q 1/2607 | 340/471 |
| D672,674 | S * | 12/2012 | Davis | D10/109.2 | |
| 8,587,453 | B2 * | 11/2013 | Cripps | G08G 1/0955 | 340/908 |
| 9,201,504 | B2 * | 12/2015 | Gohng | B60K 35/00 | |
| 9,489,841 | B1 * | 11/2016 | Huggins | G08G 1/056 | |
| 2001/0054970 | A1 * | 12/2001 | Jones | G08G 1/0955 | 340/915 |
| 2006/0232441 | A1 * | 10/2006 | Hill | E01F 9/662 | 340/907 |
| 2007/0126599 | A1 * | 6/2007 | Gembala | G08G 1/095 | 340/908 |
| 2007/0199589 | A1 * | 8/2007 | Corbero Fornt | F21S 9/037 | 136/244 |
| 2008/0129543 | A1 * | 6/2008 | Lee | G08G 1/0955 | 340/908 |
| 2009/0058680 | A1 * | 3/2009 | Benn | G09F 9/33 | 340/908.1 |
| 2016/0113105 | A1 * | 4/2016 | Bach | G06F 1/1652 | 361/749 |

* cited by examiner

MUNICIPAL WARNING LAMP

BACKGROUND

1. Field

The present disclosure relates to a field of municipal warning lamp technology, and in particular to a municipal warning lamp with high heat dissipation performance, and further has reasonable structural design, long service life, and low production cost.

2. Description of Prior Art

Warning lamps, as the name implies, serve as a warning reminder, and are generally used to maintain road safety, effectively reduce the occurrence of traffic safety accidents, and further prevent potential unsafe hidden dangers. For a construction organization, it is necessary to light the warning lamp during road construction. Especially in the situation of bad sight at night, it is easy to cause an accident in case people not familiar with the road conditions and may easily stumble and further cause traffic jams. Therefore, it is very necessary to set up the warning lamp to serve as a warning. and the same for cars driving on the road. It is very common to occasionally have some minor problems during long driving. In the case of having to park on the road, in order to ensure safety, the driver needs to place the safety warning lamp near the vehicle to remind the obstacles in the vicinity of the vehicle to avoid the and easy to be damaged. Further, the maintenance is complicated, and cannot be used better in municipal construction.

Based on the above problems, how to design a municipal warning lamp with reasonable structural design, long service life, convenient control and simple maintenance is a problem frequently considered those skilled in the art. A lot of research, development and experiments have been carried out, and a good result has been obtained.

SUMMARY

In order to overcome the problems existing in the prior art, the present disclosure provides a municipal warning lamp with high heat dissipation performance, and further has reasonable structural design, long service life and low production cost.

Compared with the prior art, the present disclosure of the municipal warning lamp comprises a control box and a warning lamp post arranged on an upper portion of the control box. The warning lamp post is of a cuboid structure. And at least three warning lights with different colors are arranged on each side of the warning lamp post. A power supply, a controller, a temperature and humidity sensor, a network communication transmission unit, an alerter, a data memory, a first telescopic driving cylinder, and a second telescopic driving cylinder are arranged in an interior of the control box. The municipal warning lamp is capable of effectively evading lightning, using the warning lights to alert the external environment, and achieving good results. Further, the use of a solar panel is able to effectively save energy.

DETAILED DESCRIPTION

To make the objects, technical proposals and merits of the present disclosure more apparent, the present disclosure will be further described in detail with reference to the drawings and embodiments. It should be understood that the embodiments described here are only used to illustrate the present disclosure and are not intended to limit the present disclosure.

Figure 1:
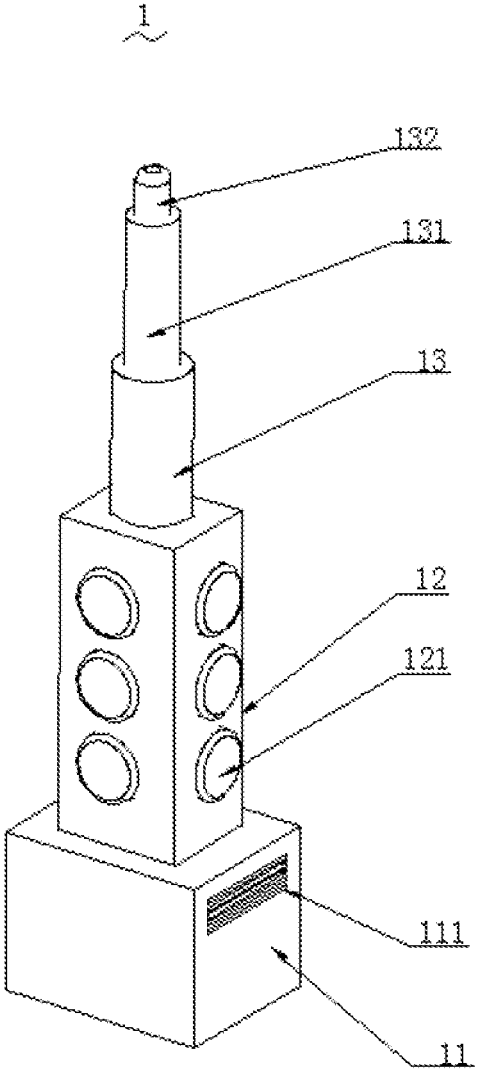
FIG. 1 is a perspective view showing a structure diagram of a municipal warning lamp of the present disclosure.
Figure 2:
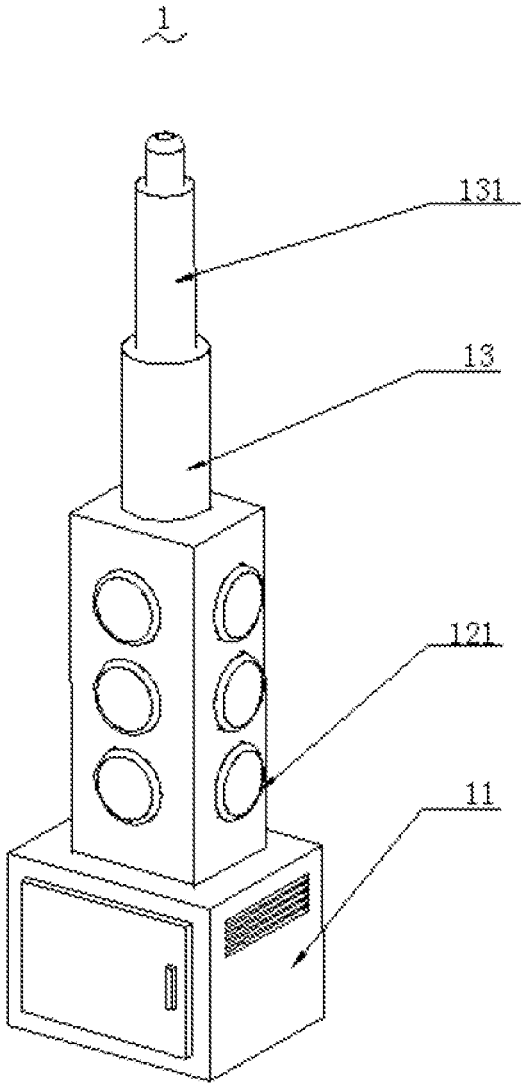
FIG. 2 is another perspective view showing a structure diagram of the municipal warning lamp of the present disclosure.
Figure 3:
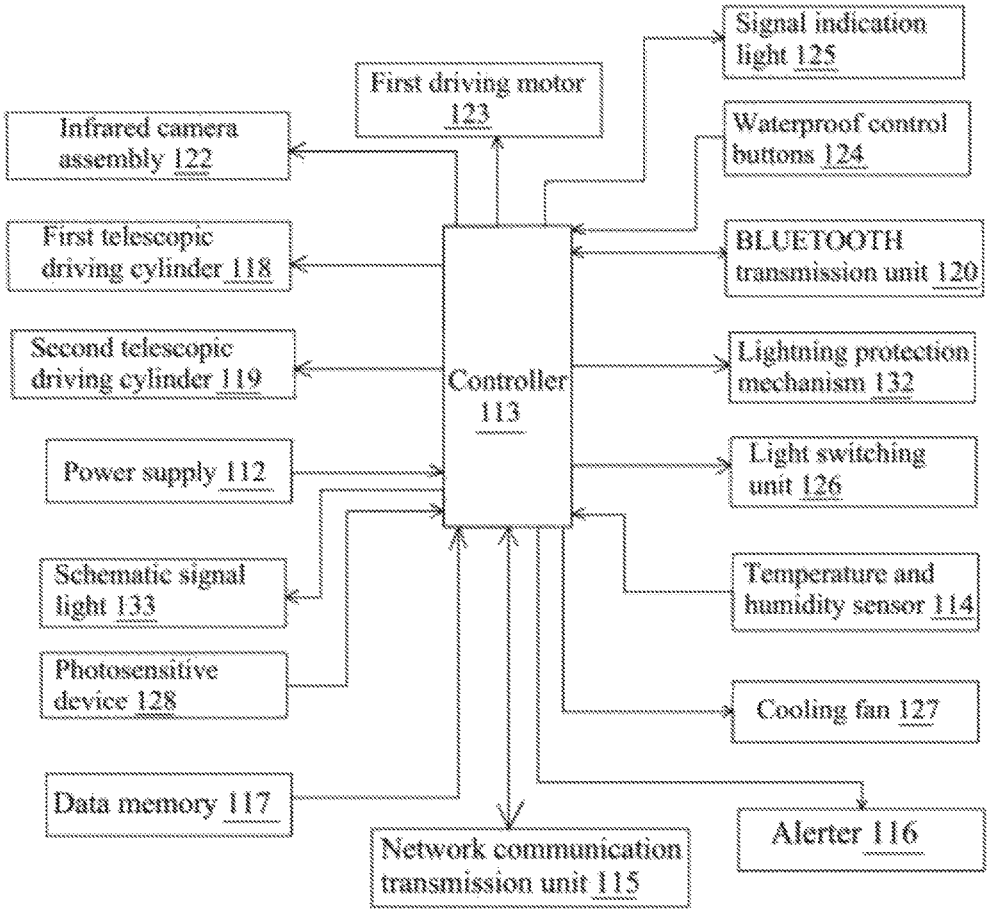
FIG. 3 is a schematic diagram showing a circuit connecting structure of the municipal warning lamp of the present disclosure.

As shown in FIG. 1 to FIG. 3, the present disclosure of a municipal warning lamp 1 comprises a control box 11 and a warning lamp post 12 arranged on an upper portion of the control box 11. The warning lamp post 12 is of a cuboid structure. And at least three warning lights 121 with different colors are arranged on each side of the warning lamp post 12. A power supply 112, a controller 113, a temperature and humidity sensor 114, a network communication transmission unit 115, an alerter 116, a data memory 117, a first telescopic driving cylinder 118, and a second telescopic driving cylinder 119 are arranged in an interior of the control box 11. The temperature and humidity sensor 114, the network communication transmission unit 115, the alerter 116, the data memory 117, the first telescopic driving cylinder 118, and the second telescopic driving cylinder 119 are electrically connected with the controller 113. A BLUETOOTH transmission unit 120 is arranged in the interior of the control box 11.

A first telescopic rod 13 is connected with an upper portion of the warning lamp post 12. And a second telescopic rod 131 is connected to an upper portion of the first telescopic rod 13. A lightning-protection mechanism 132 is fixedly disposed at a top portion of the second telescopic rod 131. The BLUETOOTH transmission unit 120 and the lightning protection mechanism 132 are electrically connected with the controller 113. An output shaft of the first telescopic driving cylinder is connected to the first telescopic rod 13. An output shaft of the second telescopic driving cylinder is connected to the second telescopic rod 131. A female clamping block is arranged on a top portion of the first telescopic rod 13, and a male clamping block configured to engage with the female clamping block is integrally formed at a bottom portion of the second telescopic rod 131. The second telescopic driving cylinder drives the second telescopic rod 131 to move upward until the male clamping block of the second telescopic rod is engaged with the first female clamping block arranged on the top portion of the first telescopic rod 13, limiting a moving distance of the second telescopic rod 131.

A light switching unit 126 configured to adjust and control a display condition of the warning lights 121 and a cooling fan 127 are arranged in the interior of the control box 11. And a solar panel configured to receive and collect solar energy is connected to an outer side of the control box 11. The light switching unit 126 and the cooling fan 127 are electrically connected with the controller 113. A fan fixing frame is arranged in an interior connecting portion of the control box 11 and the warning lamp post 12. The cooling fan is engaged in the fan fixing frame. A side portion of the control box 11 defines heat dissipation windows 111 and ventilation holes. A stabilizing mechanism assembly for fixedly connecting with an external object a ground is arranged on a bottom portion of the control box 11. And the stabilizing mechanism assembly defines a plurality of screw holes. A transparent protective cover is connected to an outside of the solar panel, where the solar panel is movably connected with the control box 11 through a rotating shaft. A photosensitive device 128 configured to sense external light irradiation direction is arranged on an outer side of the solar panel. The photosensitive device 128 is electrically connected with the controller 113. A first driving motor 123 for driving the solar panel to rotate is arranged on the rotary shaft, where the rotary shaft is arranged between the solar panel and the control box 11. The first driving motor 123 is electrically connected with the controller 113. A plurality of waterproof control buttons 124 and a signal indication light 125 are arranged on the outer side of the control box 11. The waterproof control buttons 124 and the signal indication light 125 are electrically connected with the controller 113. The control box 11 is of a square structure. An infrared camera assembly 122 is arranged on a top portion of the warning lamp post 12. The infrared camera assembly 122 is electrically connected with the controller 113. A schematic signal light 133 is arranged on a top portion of the lightning protection mechanism 132. The schematic signal light 133 is electrically connected with the controller 113.

The present disclosure of the municipal warning lamp 1 with high heat dissipation performance comprises the control box 11 and the warning lamp post 12 arranged on the upper portion of the control box 11. The warning lamp post 12 is of the cuboid structure. And at least three warning lights 121 with different colors are arranged on each side of the warning lamp post 12. The power supply 112, the controller 113, the temperature and humidity sensor 114, the network communication transmission unlit 115, the alerter 116, the data memory 117, the first telescopic driving cylinder 118, and the second telescopic driving cylinder 119 are arranged in the interior of the control box 11. The municipal warning lamp 1 is capable of effectively evading lightning, using the warning lights 121 to alert the external environment, and achieving good results. Further, the use of the solar panel is able to effectively save energy.

Furthermore, a number of the warning lights 121 arranged on each side of the warning lamp post 12 is three.

Furthermore, a connection position of the warning lamp post 12 and the control box 11, a connection position of the warning lamp post 12 and the first telescopic rod 13 are sleeved with a waterproof apron; the waterproof apron is made of silicone.

Furthermore, a video data encoding unit and a data packing unit is arranged in the interior of the control box 11. The video data encoding unit and the data packing unit are electrically connected with the controller 113.

Furthermore, a diameter of the first telescopic rod 13 ranges from 30-50 cm; a diameter of the second telescopic rod 131 ranges from 20-30 cm.

Furthermore, a protective cover is arranged on an exterior portion of the warning lights 121 arranged on each side of the warning lamp post 12.

Compared with the prior art, the present disclosure of the municipal warning lamp 1 with high heat dissipation performance comprises the control box 11 and the warning lamp post 12 arranged on the upper portion of the control box 11. The warning lamp post 12 is of the cuboid structure. And at least three warning lights 121 with different colors are arranged on each side of the warning lamp post 12. The power supply 112, the controller 113, the temperature and humidity sensor 114, the network communication transmission unit 115, the alerter 116, the data memory 117, the first telescopic driving cylinder 118, and the second telescopic driving cylinder 119 are arranged in the interior of the control box 11. The municipal warning lamp 1 is capable of effectively evading lightning, using the warning lights 121 to alert the external environment, and achieving good results. Further, the use of the solar panel is able to effectively save energy.

The above-described embodiments of the present disclosure are not to be construed as limiting the scope of the present disclosure. Any of the modifications, equivalent replacement, and improvement within the spirit and principle of the present disclosure should fall within the protection scope of the claims.

What is claimed is:

1. A municipal warning lamp, comprising:

a control box; and a warning lamp post arranged on an upper portion of the control box;

wherein the warning lamp post is of a cuboid structure, and at least three warning lights with different colors are arranged on each side of the warning lamp post; a power supply, a controller, a temperature and humidity sensor, a network communication transmission unit, an alerter, a data memory, a first telescopic driving cylinder, and a second telescopic driving cylinder are arranged in an interior of the control box; the temperature and humidity sensor, the network communication transmission unit, the alerter, the data memory, the first telescopic driving cylinder, and the second telescopic driving cylinder are electrically connected with the controller; a BLUETOOTH transmission unit is arranged in the interior of the control box;

wherein a first telescopic rod is connected with an upper portion of the warning lamp post, and a second telescopic rod is connected to an upper portion of the first telescopic rod; and a lightning-protection mechanism is fixedly disposed at a top portion of the second telescopic rod; the BLUETOOTH transmission unit and the lightning protection mechanism are electrically connected with the controller; an output shaft of the first telescopic driving cylinder is connected to the first telescopic rod, an output shaft of the second telescopic driving cylinder is connected to the second telescopic rod; a female clamping block is arranged on atop portion of the first telescopic rod; and a male clamping block configured to engage With the female clamping block is integrally formed at a bottom portion of the second telescopic rod; the second telescopic driving cylinder drives the second telescopic rod to move upward until the male clamping block of the second telescopic rod is engaged with the first female clamping block arranged on the top portion of the first telescopic rod, limiting a moving distance of the second telescopic rod;

wherein a light switching unit configured to adjust and control a display condition of the warning lights and a cooling fan are arranged in the interior of the control box; and a solar panel configured to receive and collect solar energy is connected to an outer side of the control box; the light switching unit and the cooling fan are electrically connected with the controller; a fan fixing frame is arranged in an interior connecting portion of the control box and the warning lamp post; the cooling fan is engaged in the fan fixing frame; a side portion of the control box defines heat dissipation windows and ventilation holes; a stabilizing mechanism assembly for fixedly connecting with an external object or a ground is arranged on a bottom portion of the control box, and the stabilizing mechanism assembly defines a plurality of screw holes; a transparent protective cover is connected to an outside of the solar panel; and the solar panel is movably connected with the control box through a rotating shaft, a photosensitive device configured to sense external light irradiation direction is arranged ort an outer side of the solar panel; the photosensitive device is electrically connected with the controller; a first driving motor for driving the solar panel to rotate is arranged on the rotary shaft; the rotary shaft is arranged between the solar panel and the control box; the first driving motor is electrically connected with the controller; a plurality of waterproof control buttons and a signal indication light are arranged on the outer side of the control box; the waterproof control buttons and the signal indication light are electrically connected with the controller; the control box is of a square structure; an infrared camera assembly is arranged on a top portion of the warning lamp post; the infrared camera assembly is electrically connected with the controller; a schematic signal light is arranged on a top portion of the lightning protection mechanism; the schematic signal light is electrically connected with the controller.

2. The municipal warning lamp according to claim 1, wherein a number of the warning lights arranged on each side of the warning lamp post is three.

3. The municipal warning lamp according to claim 1, wherein a connection position of the warning lamp post and the control box, a connection position of the warning lamp post and the first telescopic rod are sleeved with a waterproof apron; the waterproof apron is made of silicone.

4. The municipal arm ng lamp according to claim 1, wherein a video data encoding unit and a data packing unit is arranged in the interior of the control box; the video data encoding unit and the data packing unit are electrically connected with the controller.

5. The municipal warning lamp according to claim 1, wherein a diameter of the first telescopic rod ranges from 30-50 cm; a diameter of the second telescopic rod ranges from 20-30 cm.

6. The municipal warning lamp according to claim 1, wherein a protective cover is arranged on an exterior portion of the warning lights arranged on each side of the warning lamp post.

* * * * *